US005620306A

United States Patent [19]

Day

[11] Patent Number: 5,620,306

[45] Date of Patent: Apr. 15, 1997

[54] IMPELLER

[75] Inventor: Terence R. Day, Coombabah, Australia

[73] Assignee: Magiview Pty. Ltd., Queensland, Australia

[21] Appl. No.: 424,461

[22] PCT Filed: Nov. 10, 1993

[86] PCT No.: PCT/AU93/00581

§ 371 Date: May 3, 1995

§ 102(e) Date: May 3, 1995

[87] PCT Pub. No.: WO94/11638

PCT Pub. Date: May 26, 1994

[30] Foreign Application Priority Data

Nov. 12, 1992 [AU] Australia ..... PL5790

[51] Int. Cl.[6] ..... F04D 29/24; F04D 29/30

[52] U.S. Cl. ..... 416/185; 416/188

[58] Field of Search ..... 416/185, 188

[56] References Cited

U.S. PATENT DOCUMENTS

| | | | |
|---|---|---|---|
| 2,284,141 | 5/1942 | Funk | 416/188 |
| 2,484,554 | 10/1949 | Concordia et al. | 416/188 |
| 4,647,271 | 3/1987 | Nagai et al. | 416/188 |

FOREIGN PATENT DOCUMENTS

| | | | |
|---|---|---|---|
| 202858 | 12/1955 | Australia . | |
| 210289 | 7/1956 | Australia . | |
| 2282058 | 8/1974 | France | 416/185 |
| 0338436 | 8/1920 | Germany | 416/185 |
| 0062998 | 4/1982 | Japan | 416/188 |
| 0223493 | 10/1987 | Japan | 416/188 |
| 0130598 | 6/1991 | Japan | 416/185 |
| 464715 | 7/1975 | U.S.S.R. . | |
| 1010805 | 11/1965 | United Kingdom | 416/185 |
| 2224083 | 4/1990 | United Kingdom . | |

*Primary Examiner*—Edward K. Look
*Assistant Examiner*—Christopher Verdier
*Attorney, Agent, or Firm*—Hoffman,Wasson & Gitler

[57] ABSTRACT

A pressure boost impeller configured for compressing fluids, such as gases and liquids. Such impeller has a front intake area and a rear discharge area, and a hub containing the rotational axis of the impeller. Several blades extend about the hub, with some of the blades being in an overlapping relationship to define a passageway between adjacent blades. The passageway has an inlet communicating with the front intake area and an outlet communicating with the rear discharge area. The inlet is greater in area than the outlet, thus defining a step down in volume of fluid passing through the passageway.

10 Claims, 4 Drawing Sheets

| Outlet Diam (mm) | FAN SPEED RANGE | STATIC PRESS (Pa) | EXIT VELOC (m/s) | VOLUME FLOW (Litres/s) | DYNAMIC PRESS (Pa) | TOTAL PRESS (Pa) |
|---|---|---|---|---|---|---|
| 78 | 1 | 406 | 36.8 | 176 | 259 | 665 |
| 78 | 2 | 503 | 42.6 | 204 | 347 | 850 |
| 78 | 3 | 780 | 47.9 | 229 | 439 | 1219 |
| 64 | 1 | 1155 | 50.0 | 161 | 217 | 1372 |
| 64 | 2 | 1516 | 58.7 | 189 | 299 | 1815 |
| 64 | 3 | 1752 | 62.1 | 200 | 334 | 2086 |
| 52 | 1 | 1998 | 61.2 | 130 | 141 | 2139 |
| 52 | 2 | 2480 | 69.0 | 147 | 180 | 2660 |
| 52 | 3 | 3059 | 79.7 | 169 | 240 | 3299 |
| 34 | 1 | 2965 | 71.4 | 63 | 35 | 3000 |
| 34 | 2 | 3769 | 79.3 | 72 | 43 | 3812 |
| 34 | 3 | 4100 | 87.4 | 79 | 52 | 4152 |
| 10.5 | 1 | 4066 | 74.6 | 6.46 | 34 | 4100 |
| 10.5 | 2 | 4927 | 90.6 | 7.84 | 50 | 4977 |
| 10.5 | 3 | 6616 | 105 | 9.09 | 67 | 6683 |

1 - 18300 rpm 2 - 21000 rpm 3 - 22500 rpm

IMPELLER

TECHNICAL FIELD

This invention relates to an impeller and especially to a pressure boost impeller suitable for compressing fluids such as gases and liquids.

BACKGROUND ART

Known impellers or fans can include an arrangement of airfoils. By airfoils is meant a foil or blade which is substantially a version of a wing. A typical wing or foil has a shape which creates a greater distance over one side, which is usually the topside, than the opposite side.

This configuration of a typical foil or wing when driven forward with its thickest end foremost splits the ambient fluid, be it gases or liquids to cause a portion to pass over the top and a portion to pass underneath. The greater distance the fluid travels over the side with the greatest curve, which is usually the top, forces that fluid to a tendency toward being attenuated.

This substantial attenuation causes a lowering of pressure. The lowered pressure attracts adjacent fluid and the effect is to create an upward suction. If the wing or foil cannot rise, the fluid travels down to meet it and usually passes mostly behind the trailing edge.

In this type of foil or wing it can be seen that there is a direct relationship between each side of the wing or foil.

If, because of a too coarse pitch (nose up) the pressure underneath becomes too high and the pressure above becomes too low, the foil or wing will stall. In this case the high pressure fluid from the underside creeps around the Trailing edge and forward along the topside and causes detachment of the topside fluid flow. Upwards suction is lost or greatly diminished and therefore loss of lift occurs.

High pressure air also travels around the foil or wing tips and creates vortices, which detracts from lift and creates a drag on the foil near its tips.

A typical conventional fan is almost always a circular arrangement of these foils or small wings and is subject to the same factors which cause a loss of efficiency.

In a typical conventional radial flow fan, the foils or miniature wings diverge from each other from a medial to a lateral area. In this situation, each foil or wing relies on the lower pressure air travelling over the low pressure side of the foil or wing to substantially reach the trailing edged to rejoin the higher pressure air being flung radially by the high pressure side of the foil. So in this type of fan is subject to having its blades or foils stall if a back pressure or head pressure is generated. If this type of fan is driven to too high tip speed each foil stalls and in certain circumstances fluid can actually travel back between each set of foils along the low or suction side of the foils. In effect there is created a counter current of fluid between any two foils.

DISCLOSURE OF THE INVENTION

It is an object of the invention to provide an impeller which may substantially overcome the abovementioned disadvantages or provide the public with a useful or commercial choice.

In one form, the invention resides in an impeller having a front intake area and a rear discharge area, a hub containing the rotational axis of the impeller, a plurality of blades extending about the hub, at least some of the blades being in an overlapping relationship to define a passageway between adjacent overlapping blades, the passageway having an inlet communicating with the front intake area, and an outlet communicating with the rear discharge-area, the inlet having an area larger than the area of the outlet to define a step down in volume of fluid passing through the passageway.

The blades extending about the hub may have a leading edge which can define part of the inlet, a trailing edge which can define part of the outlet, an outwardly extending tip, and a root which can be attached to the hub.

The blades can be attached to the hub at a distance spaced from the rotational axis to define a land portion between the blades and the rotational axis. This land portion can cover between 10% to 50% of the area of the hub, and typically comprises at least 30%. The root of the blades can be attached to the hub adjacent the rear discharge area.

The blades may have an airfoil configuration whereby the leading edge can be thickened relative to the trailing edge and whereby incoming fluid can be split to cause a portion of the fluid to pass over one side of the blade, and a portion of the fluid to pass on the other side of the blade. Due to the airfoil configuration, fluid passing over one side of the blade must travel along a longer pathway than fluid passing along the other side of the blade which causes attenuation of the fluid. The blades may be curved between the leading edge and the trailing edge and therefore adjacent blades may be in a curved overlapping relationship.

The hub may be substantially cone-like in configuration and may diverge from the intake area to the discharge area. The blades may be attached to the cone shaped hub. The discharge area of the hub may be substantially planar.

At least some of the blades, and preferably all of the blades may be angled outwardly relative to the rotational axis. Thus, a line defined between the root and tip of a particular blade may diverge from the rotational axis of the hub.

Although the degree of overlap between adjacent blades may vary, it is preferred that the overlap is at least 50% to allow the desired passageway to be formed.

To achieve the step down in volume between the inlet and the outlet of the passageway, the adjacent blades defining the passageway may converge relative to each other from the leading edge to the trailing edge. The leading edge and the trailing edge of each adjacent blade may be substantially the same length, with the convergence of the blades resulting in the step down in volume along the passageway. The adjacent blades may be of a rigid construction and may be fixed in the desired converging position.

Alternatively, the degree of convergence may be varied either before and/or during rotation of the impeller. Thus, the blades may be pivotally mounted adjacent their leading edges to allow the blades to pivotally move towards an adjacent blade. Alternatively, or in addition to the above, some or all of the blades may be flexible, or comprise a flexible portion which can alter the shape of the blade to allow it to converge relative to the adjacent blade.

In a further alternative, the step down in volume may be achieved by having the leading edges of an adjacent pair of blades longer than the trailing edges of the same adjacent pair of blades. In this alternative, the tip of each blade can taper from the leading edge to the trailing edge. The blades may be substantially parallel and need not converge, although they do if desired. Indeed, depending on the ratio between the leading edge length and the trailing edge length, the blades may even diverge while still providing a step down in volume.

It is also desirable to have the intake area larger than the inlet area of the passageways. Thus, the intake area may be defined by the junction of the leading edge and the tip of each blade. If the blades are angled outwardly from the rotation axis, the intake area (ie. eye or throat area) can be considerably larger than the inlet area (ie. blade swept area).

The impeller can be fitted to a rotating shaft and can be mounted within a shroud or housing, with the tips of each blade being sealingly engagable with the shroud or housing, or being closely spaced therefrom. The shroud or housing may be concave in configuration to encompass the impeller.

BEST MODE

Figure 1:
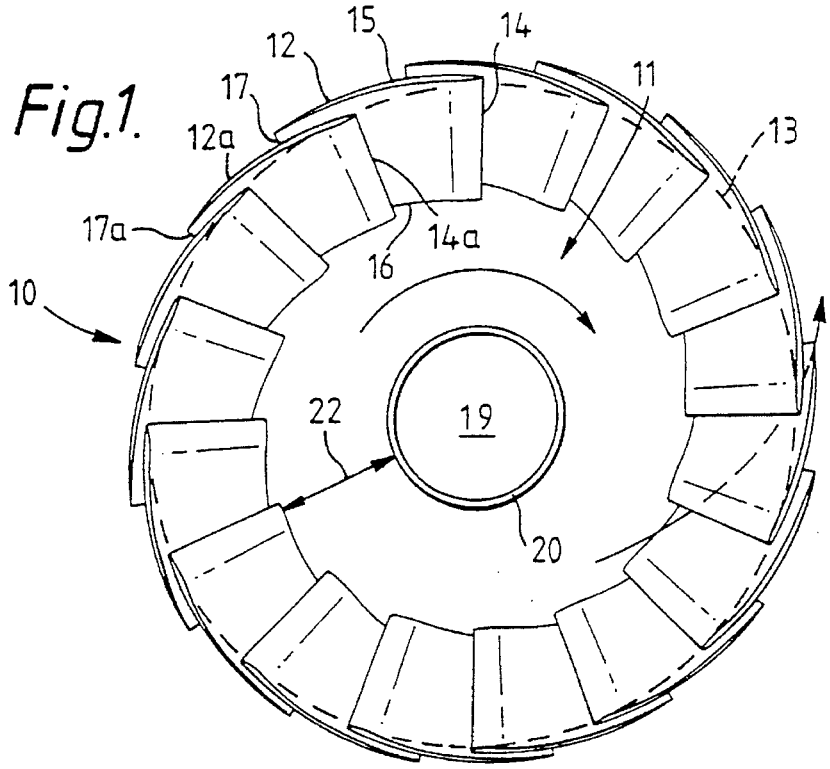
FIG. 1 is a plan view of an impeller according to the invention.

Referring to the drawings and initially to FIG. 1 there is shown an impeller 10. Impeller 10 can be formed from metal (although need not be limited to such), and comprises a central hub 11 and a plurality of blades 12. Impeller 10 also includes an intake area shown by dotted line 13 and which can be defined by the junction of a leading edge 14 and a tip 15 of a particular blade 12. Each blade 12 includes a leading edge 14 which communicates with intake area 13, an outwardly extending tip 15, a root 16 by which the blade is attached to hub 11, and a trailing edge 17 which communicates with a discharge area 18 (see FIG. 2) of impeller 10. Hub 11 has a central rotational axis 19, and in FIG. 1 hub 11 includes a central bore 20 so that impeller 10 can be mounted to a shaft (not shown) for rotation therewith.

Blades 12, 12*a* are in an at least partially overlapping relationship to define a passageway 21 extending between the pair of adjacent blades 12, 12*a*. The adjacent blades have an overlap area of between 30 to 70 percent to ensure the existence of a reasonably sized passageway 21.

Figure 2:
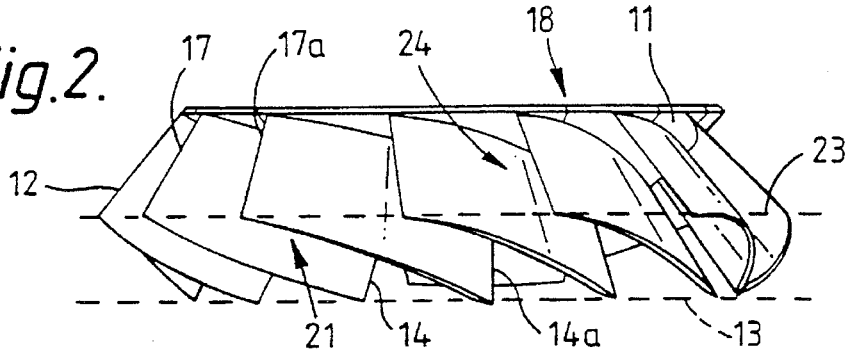
FIG. 2 is a side view of the impeller of FIG. 1.

The blades on hub 11 diverge outwardly relative to the rotational axis 19 as shown in FIG. 1. This outward divergence results in a large intake area 13. This can be achieved by having hub 11 cone-like in configuration as illustrated in FIG. 2, with the hub diverging from a narrower portion adjacent the front intake area to a broader portion extending to the rear discharge area. By having blades 12 mounted substantially at right angles to the inclined cone-like surface of hub 11, the blades will adopt the divergent position shown in FIGS. 1 and 2.

The root of each blade is attached to the hub at a position substantially spaced from the rotational axis, to give hub 11 a land portion 22 (see FIG. 1) extending between the rotational axis 19, or bore 20 and the root of each blade. The land portion may comprise between 20 to 60 percent of the surface area of the hub. That is, blades 12 do not extend all the way towards either the rotational axis 19 or bore 20.

FIG. 2 shows in dotted outline 23 the discharge area, or outlet 24 of each passageway defined between an adjacent pair of blades.

Figure 3:
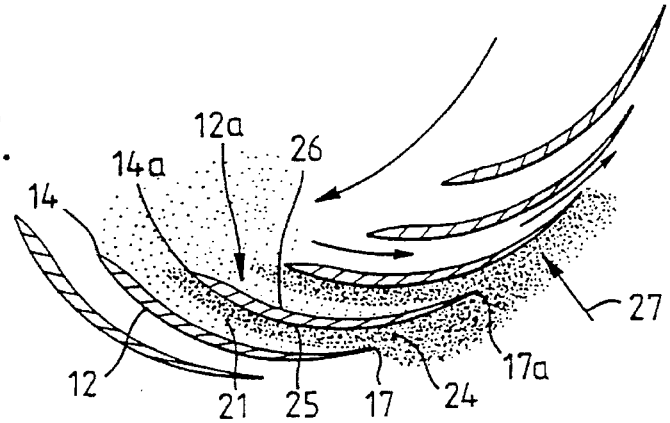
FIG. 3 is a representation of fluid flowing past adjacent blades of the impeller.

Referring to FIG. 3, it can be seen that the blades have an airfoil type configuration comprising a thickened leading edge 14, 14*a* and a thinner trailing edge 17, 17*a*. The airfoil configuration of each blade, results in the fluid being split by a respective leading edge 14, 14*a* into a portion which flows over an upper side of the blade 25 and a portion that flows over the lower side of the blade 26. The lower side 26, defines a longer pathway for the fluid to travel, and this causes a reduction in pressure of the fluid on surface 26 relative to surface 25.

When impeller 10 is rotated, the incoming fluid is compressed against upper side 25 (as shown in FIG. 3). At the same time, fluid on the lower side 26 is decompressed, rarified or attenuated causing a reduction in pressure. As the fluid is compressed and travels along upper surface 25 of each blade, if the trailing edge of the adjacent blade is spaced from upper surface 25 by a distance approximating the thickness of the compressed fluid passing along upper surface 25, then there is a substantial reduction in the tendency of the fluid to flow backwards along the low pressure side of the blade.

Thus, as shown in FIG. 3, adjacent blades converge relative to each other between their leading edges and trailing edges, with the distance between the trailing edge 17 of one blade between upper surface 25 of an adjacent blade approximating the "thickness" of the high pressure fluid flowing through passageway 21 and along the upper surface 25 of the blade.

As the fluid is driven into a high pressure area adjacent the discharge are 18, the head pressure in this area is exerted substantially perpendicular to the inflow direction of the fluid passing into the higher pressure area. This is illustrated as numeral 27 in FIG. 3 which shows that as high pressure fluid passes through outlet 24, the head pressure in the discharge area (for instance a compression tank) does not exert itself totally against the flow but substantially perpendicular to the flow.

Only when the energy found as pressure and or velocity of the incoming gases is exceeded by the energy found as pressure of the gases adjacent the member trailing edges (as in a plenum chamber or pressure vessel) can the inflow be substantially disturbed or prevented.

With fixed pitch members this ability of the impeller 10 to compress gases is found within a relatively narrow speed range.

As liquids are substantially incompressible, the degree of said member convergence need only be to the extent of adjusting at the design point a situation where the impeller 10 inflow side is approximately the same as the outflow side for almost any R.P.M.

Figure 6:
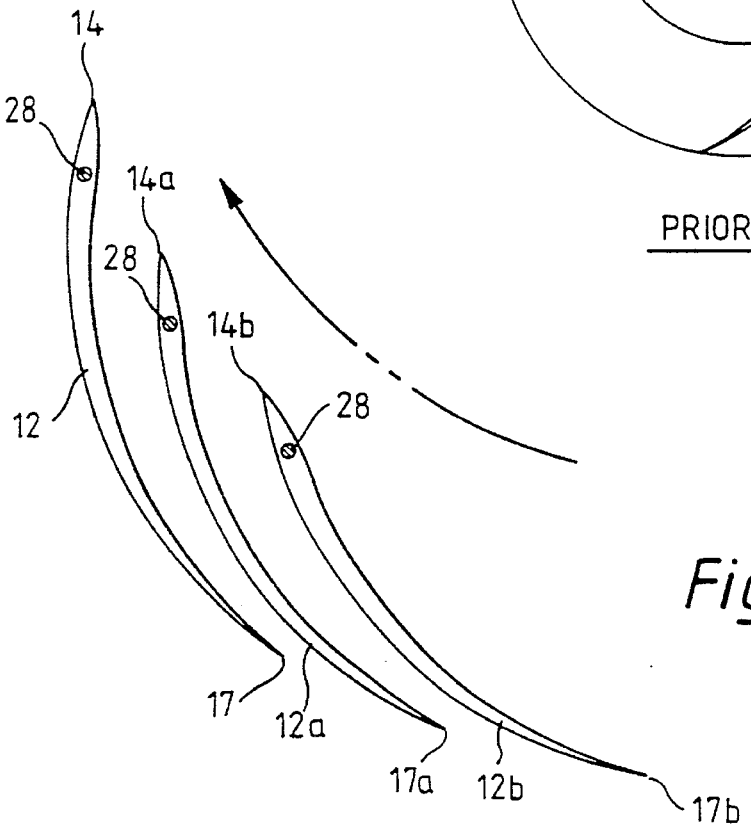
FIG. 6 is a schematic view of pivotal blades of an impeller according to the invention.

FIG. 6 illustrates three representative airfoil shaped blades 12, 12*a*, 12*b* which are pivotally mounted through pivot points 28 to the hub (not shown). The pivot points being adjacent the leading edges 14, 14*a*, 14*b*. During rotation of the impeller in the direction of arrow illustrated in FIG. 6, these blades can be self tuning with the trailing edges being automatically positioned away from the upper surface of an adjacent blade by the approximate thickness of the high pressure fluid flow flowing across the upper surface. This self alignment is caused by the high pressure fluid flow on the upper surface of each of the blades 12, 12*a*, 12*b* tending to pivot the blade towards the upper surface of an adjacent blade, with the high pressure fluid on the adjacent blade limiting the degree of pivoting movement. This self tuning or self adjusting effect can also be achieved by having the blades formed from flexible material, or a portion of the blade adjacent the trailing edge being formed from flexible material which can then deform to be self adjusting.

Figure 4:
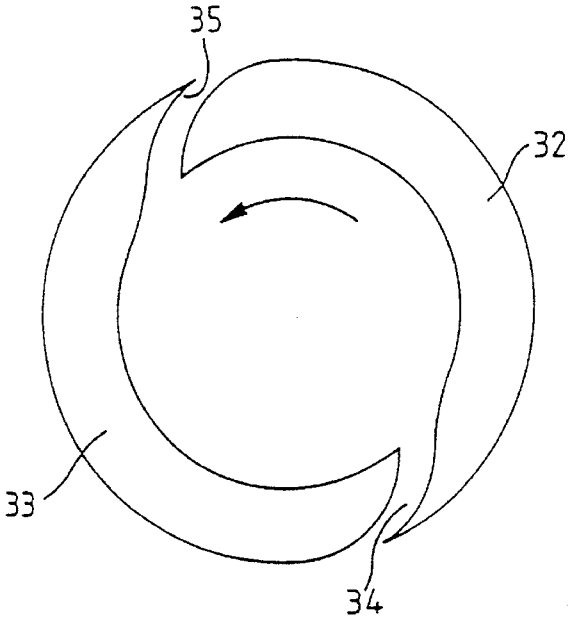
FIG. 4 is a schematic view of a two passageway impeller according to an embodiment of the invention.
Figure 5:
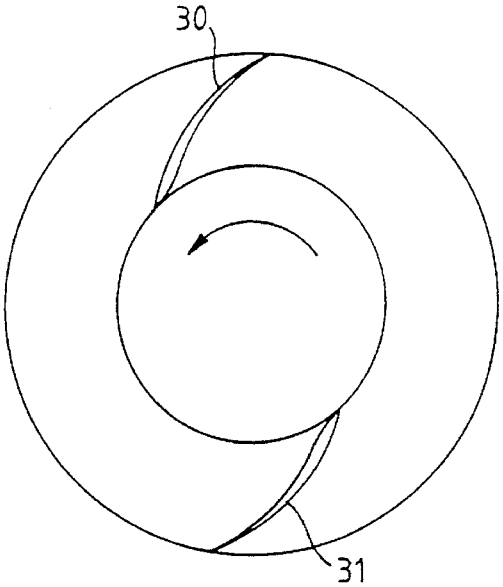
Fig. 5. PRIOR ART
FIG. 5 is a schematic view of a prior art two bladed radial flow fan.

FIGS. 4 and 5 illustrate the significant difference between a prior art radial fan employing only two blades (FIG. 5) with an impeller according to an embodiment of the invention employing two passageways (FIG. 4). With the prior art fan of FIG. 5, the area between each blade 30, 31 performs no function. In FIG. 4, the impeller is shown as solid material 32, 33 which performs no function between the passageways 34, 35 and this shows that with the impeller the work is performed between any two of the blades and that the relationship is between the high pressure side of one blade and the low pressure side of an adjacent blade. In the case of a conventional radial flow fan employing airfoil shaped blades, the work of transporting the fluid is performed substantially along the full length of both sides of the blade. With the impeller the work of compressing and transporting the fluid is performed substantially between the leading edge of each blade and a trailing edge of an adjacent blade.

Figure 7:
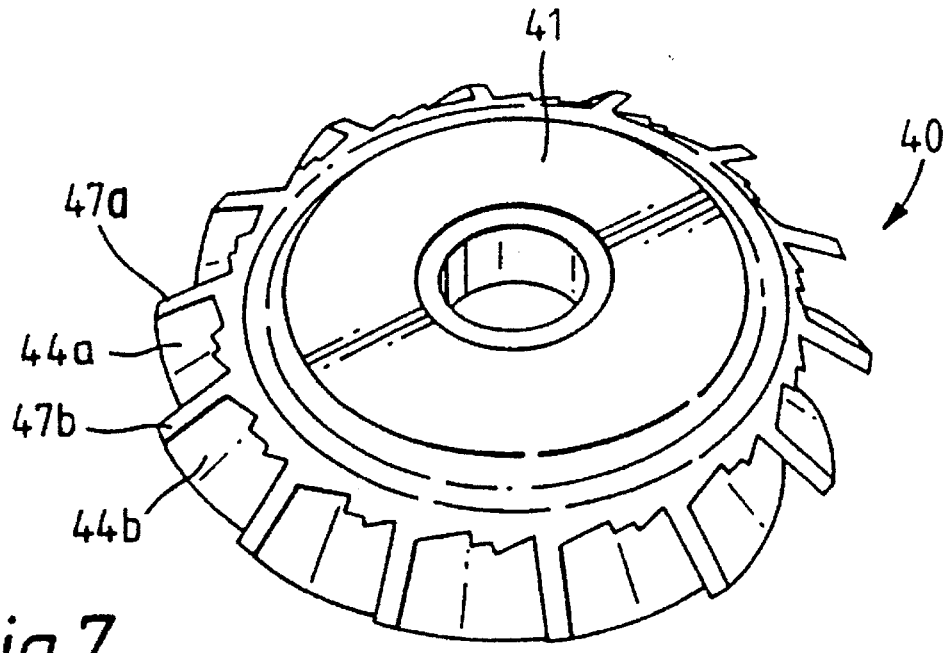
FIGS. 7 and 8 are rear and front views of an impeller according to a further embodiment of the invention.
Figure 8:
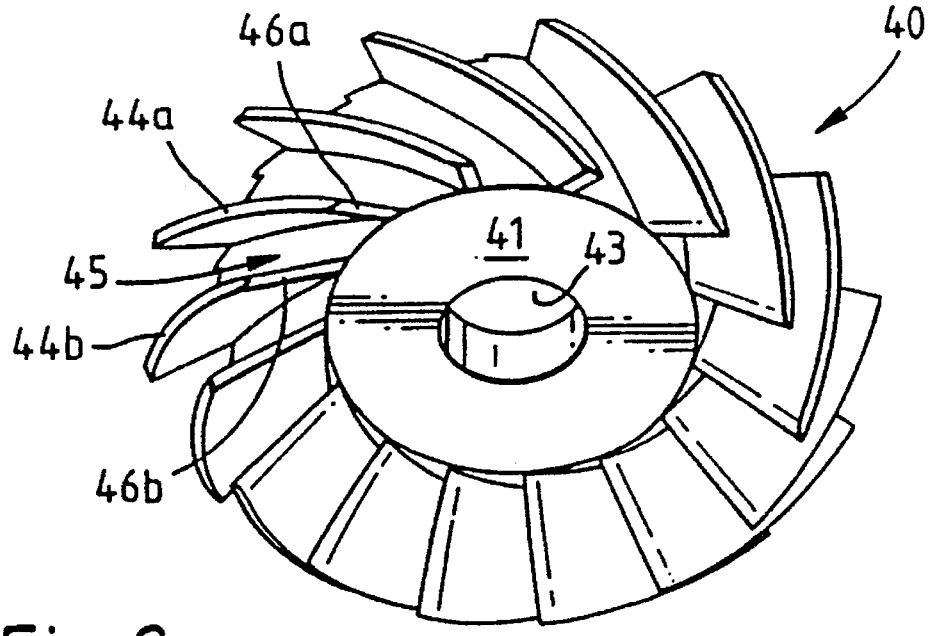

FIGS. 7 and 8 illustrate an alternative embodiment of the impellor. In this embodiment, impellor 40 includes a hub 41 similar to that described earlier, the hub having a bore 42 to allow the impellor to be mounted to a shaft. A plurality of blades 44*a*, 44*b* are spaced about a peripheral area of the impellor, and are mounted to hub 41. Blades 44*a*, 44*b* are in a spaced overlapping configuration to define a passageway 45 between an adjacent pair of overlapping blades (ie. 44*a*, 44*b*). Passageway 45 has an inlet and an outlet similar to that described above, and also has a step down in volume between the inlet and the outlet by having the leading edge 46*a*, 46*b* of each respective blade longer than the trailing edge 47*a*, 47*b*. Thus, passageway 45 tapers downwardly from the inlet to the outlet of passageway. Depending on the length of the leading edges to the trailing edges, adjacent blades 44*a*, 44*b* need not converge, but may be in a curved parallel relationship, or even slightly divergent while still providing the step down in volume.

Some versions of the impeller may when viewed from the side, possess blades which are arranged at angles other than parallel to a line which is at right angle (90°) to the axis. There are advantages in this in certain circumstances. For example when comparing this angled blade configuration of the impeller with a conventional radial flow fan it can be seed that the eye or fluid intake face of the impeller is much larger than the eye of a conventional radial flow fan. It can also be seen that the said blade swept area of the impeller is much larger than the blade swept area of the conventional radial flow flan.

The angled blade version of the impeller also makes it possible to more readily turn the fluid after it has passed through the impeller into an axial direction while still having taken advantage of the centrifugal effect common to a radial flow fan or the impeller. Versions of the impeller with angled blades as described may also feature the converging blades already described. The tips 15 of the blades of the impeller are meant to pass closely by a shroud. This shroud is not shown in any of the drawings for clarity.

Figures 9, 10:
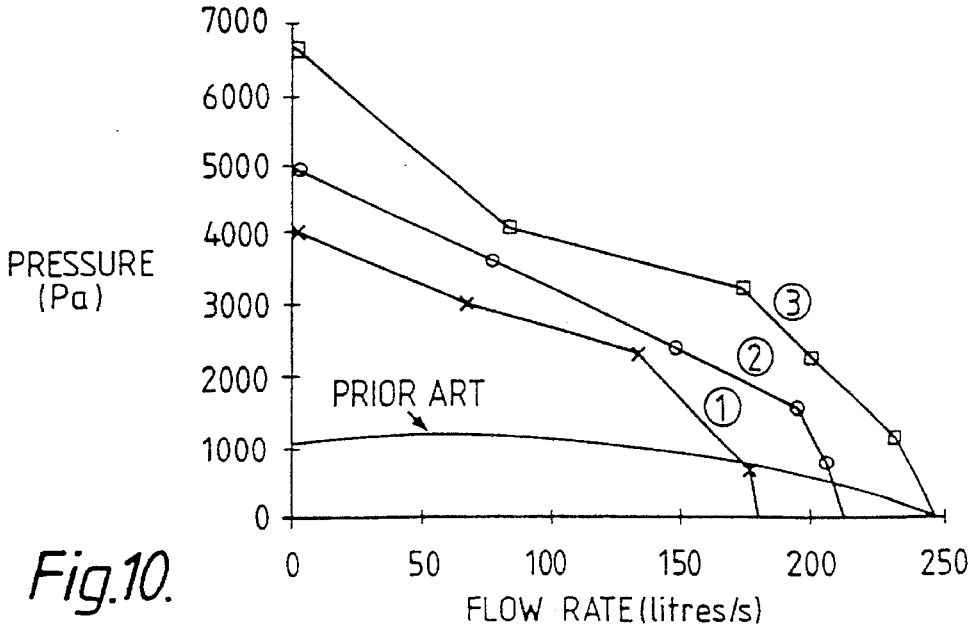
FIG. 9 is a table showing various parameters of the impeller of FIG. 1.
FIG. 10 is a graphical representation of the results of the table in FIG. 9.

FIGS. 9 and 10 illustrate a table, and in graphical form the advantages of the impeller. The information indicates that the impeller resists stall and can maintain high static pressure at very low flow rates. The impeller does not follow the traditional fan curve illustrated in standard handbooks.

A typical centrifugal type compressor may possess blades or airfoils that do overlap, however those blades diverge from a medial towards a peripheral area whereas the blades of the impeller may converge.

A centrifugal type compressor relies on a gas velocity change to achieve compression. Gas is drawn into a relatively small eye, undergoes a direction change from axial to radial and is flung outwardly at high velocity. In this type of compressor the highest gas velocity is achieved as it comes off the blade trailing edges. This high velocity gas is almost immediately reduced in velocity and undergoes a pressure rise. In the centrifugal type compressor the pressure gain is relatively small.

Note that in the centrifugal type compressor, gases are first compressed against the advancing high pressure side of each blade or foil. The gases then undergo a reduction in pressure as they are flung off the blade tips at high velocity. They then undergo a pressure increase as their velocity is reduced. This rapid change in velocity and pressure contributes to inefficiency.

The impeller in having the said blades placed more peripherally and in such a manner as to maximise compression of gases against the advancing high pressure side of the blades, achieves the desired high pressure rise between the said blades and does not produce the subsequent pressure reduction and pressure increase of the gases after leaving the blades as does the centrifugal compressor.

Stated another way: The impeller achieves the desired pressure rise between the members or more specifically between the leading edge of a given blade and the trailing edge of the preceding blade. In this way the angled member version of the impeller minimises gas direction change: offers increased eye or gas intake area: and achieves the objective of gas compression in substantially one action instead of three abrupt velocity and pressure changes as in the centrifugal type compressor. It is to be noted that typical axial flow compressors achieve compression by the same means of velocity reduction as do centrifugal compressors and both are subject to blade or airfoil stall; a problem which the impeller substantially reduces. Also note that the large eye or fluid intake face of the angled blade versions of the impeller may take advantage of the ram effect when used in place of a conventional forward moving ducted fan or axial flow compressors.

The impeller can be used in place of underwater propellers. The blades of the impeller may be at any angle relative to the plate-like or cone-like hub. The cone-like hub may be at any cone angle.

The cone-like hub and said blade tips may possess a radius. The blades of the impeller may have a twist when viewed from any angle.

The blade of the impeller may possess a radius that alters along their length.

The blades of the impeller may possess a constant thickness or a sharp leading edge and or trailing edge.

The blade of the impeller when viewed from the side may have their root and tip angles the same or different relative to each other.

What is claimed is:

1. An impeller having a front intake area and a rear discharge area, a hub containing a rotational axis of the impeller, a plurality of blades extending about the hub, at least some of the blades being in an overlapping relationship to define a passageway between adjacent overlapping blades, the passageway having an inlet defined by a leading edge of each adjacent blade and communicating with the front intake area, and an outlet defined by a trailing edge of each adjacent blade and communicating with the rear discharge area, wherein each blade is curved to define an outer convex side and an inner concave side, the outer convex side adapted to impact against and compress fluid as the impeller rotates, each blade further having a lower root edge and an upper free tip edge, the adjacent overlapping blades converging towards each other from the inlet to the outlet, the leading and trailing edges of each blade diverging outwardly from the rotational axis.

2. The impeller as claimed in claim 1, wherein the blades are spaced from the rotational axis of the hub to define a land portion between the rotational axis and one of said blades.

3. The impeller as claimed in claim 2, wherein the land portion comprises at least 30% of the area of the hub.

4. The impeller as claimed in claim 3, wherein the blades are attached to the hub adjacent the discharge area.

5. The impeller as claimed in claim 2, where The blades have an airfoil configuration from the leading edge to the trailing edge.

6. The impeller as claimed in claim 1, wherein the hub is substantially cone shaped and diverges from the intake area to the discharge area.

7. The impeller as claimed in claim 1, wherein the degree of overlap between adjacent blades is at least 30%.

8. The impeller as claimed in claim 1, wherein the blades are fixed in the converging position.

9. The impeller as claimed in claim 1, wherein the intake area is larger than the inlet area of one of said passageways such that a step down in volume is achieved between the intake area and the inlet area.

10. The impeller as claimed in claim 1, wherein said impeller is a fluid compressor impeller.

* * * * *